United States Patent [19]

Jessop et al.

[11] Patent Number: 4,600,451

[45] Date of Patent: Jul. 15, 1986

[54] PERCHLORATE BASED MICROKNIT COMPOSITE EXPLOSIVES AND PROCESSES FOR MAKING SAME

[75] Inventors: Harvey A. Jessop, Lehi; M. Taylor Abegg, Salt Lake City; John A. Peterson, Brigham City; Jay W. Butler, Bountiful, all of Utah; Ronald F. McCormick, Wilmslow, England; Ormand F. Lavery, personal representative of said Harvey A. Jessop, deceased

[73] Assignee: Megabar Explosives Corporation, Ogden, Utah

[21] Appl. No.: 578,178

[22] Filed: Feb. 8, 1984

[51] Int. Cl.[4] ..... C06B 45/10

[52] U.S. Cl. ..... 149/19.3; 149/18; 149/19.1; 149/19.5; 149/19.6; 149/19.9; 149/19.91; 149/40; 149/41; 149/42; 149/43; 149/44; 149/45; 149/46; 149/47; 149/61; 149/62; 149/70; 149/76; 149/77; 149/78; 149/83; 149/85; 149/92

[58] Field of Search ..... 149/18, 19.1, 19.3, 149/19.5, 19.6, 19.9, 19.91, 40–47, 61, 62, 70, 76, 77, 78, 83, 85, 92

[56] References Cited

U.S. PATENT DOCUMENTS 3,996,078 12/1976 Klunsch et al. ..... 149/2
4,128,442 12/1978 Barlow ..... 149/46
4,391,659 7/1983 Smith ..... 149/2
4,434,017 2/1984 Smith et al. ..... 149/2

FOREIGN PATENT DOCUMENTS 2125782 3/1984 United Kingdom .

*Primary Examiner*—Stephen J. Lechert, Jr.
*Attorney, Agent, or Firm*—K. S. Cornaby

[57] ABSTRACT

A new arrangement of matter is developed which can be formulated to be a high explosive, a propellant or a gas generator. The new arrangement of matter in its explosive embodiment is known as a microknit composite explosive (MCX) in which an essentially anhydrous mixture of perchlorate based oxidizer salts, surfactants and organic fuels is prepared while the oxidizer is molten, and a microcrystalline property is created which imparts a hard, machinable characteristic to the arrangement of matter. The invention includes three processes for making MCX compositions: (1) dissolving surfactants, crystal-habit modifiers, thickeners or combinations into the molten oxidizer in a manner which permits supercooling with subsequent solidification; (2) forming an unstable oil-continuous emulsion as a preliminary step, followed by a controlled disruption of the oil-phase continuum which causes the composition to solidify after supercooling, and (3) retarding crystal nucleation in salt-continuous emulsions by introducing surfactants, thickeners, crystal-habit modifiers or combinations, along with immiscible fuels, resulting in supercooling and subsequent solidification to a hard composition.

28 Claims, No Drawings

PERCHLORATE BASED MICROKNIT COMPOSITE EXPLOSIVES AND PROCESSES FOR MAKING SAME

BACKGROUND OF THE INVENTION

Explosive compositions may be divided into two categories: molecular or homogeneous explosives, wherein the molecule of the compound contains chemical moieties which confer explosive properties, and composite or heterogeneous explosives wherein mixtures of fuels and oxidizers can be made to be explosive.

Composite explosives are made by mixing oxidizing salts, usually perchlorates or nitrates, with appropriate amounts of organic or metallic fuels. Many useful explosives are thus made, and it has been found that such mixtures are improved in utility and performance by formulating the mixtures as slurries or emulsions, which improves the intimacy of contact between the fuel and oxidizer. Further, such compositions are pumpable, which greatly facilitates their manufacture and placement for use.

Another type of composite explosive is made by mixing two or more molecular explosives. Typical of these are melt-cast formulations which are widely used as fills for military explosive ordnance. A commonly used explosive mixture is made by melting trinitrotoluene (TNT), which melts at a relatively low temperature, and then introducing into the liquid TNT matrix a large fraction of a granular solid explosive such as cyclotrimethylenetrinitramine (RDX) of higher melting temperature which is dispersed and suspended as a particulate solid in the TNT matrix. This mixture can be poured at temperatures above the TNT melting point, and upon cooling the mixture becomes hard.

Because of the high cost of TNT, efforts have been and are being made to employ eutectic mixtures of inorganic oxidizers (principally ammonium nitrate) and explosive compounds such as ethylenediaminedinitrate as a replacement for TNT.

Both the hard melt-cast composite formulations and the soft emulsion or slurry composite formulations are successful, but each suffers from certain disadvantages.

Mixing of molecular explosives is usually accomplished in melt kettles where large quantities of explosives are present in one mass and large distances must separate accumulated quantities of explosives. Of concern are the hazards associated with long dwell times at elevated temperatures because of the increased hazards at higher temperatures. Also troublesome is the shrinkage of these mixtures upon cooling and solidification along with accompanying density gradients, all of which must be accomodated for proper ordnance design.

The direction of development of emulsions and slurries has been toward soft or pumpable explosives for commercial blasting operations. Recent developments in such explosive formulations have been water-in-fuel emulsions, having soft or semi-soft consistencies. Patents for such emulsions teach stabilization techniques and fuel-phase continuity.

A further development is disclosed in two U.S. Pat. Nos. 4,248,644 and 4,391,659 which teach melt-in-fuel emulsion technology. As taught by these patents, either aqueous salt solutions or essentially anhydrous molten salts can be emulsified with an immiscible hydrocarbon fuel. The hydrocarbon fuel becomes the continuous phase. The discontinuous droplets of oxidizer are very small, and an extremely intimate mixture of fuel and oxidizer is thus obtained. In such oil-continuous emulsions, coalescence and crystallization of the discontinuous droplets of oxidizer may be prevented by making the droplets of oxidizer sufficiently small, and the surface tension such that nucleation may be inhibited; supersaturation or supercooling is achieved, and the emulsion, even though made with molten oxidizer, is formulated to remain grease-like or extrudable at ambient termperature.

The stabilization of the oil-continuous emulsified state has been a principal objective of recent developments. A soft consistency is desirable for many applications in commercial blasting, and emulsions provide extremely intimate mixtures in a meta-stable state, giving them distinct advantages in explosive sensitivity. Stabilization of the emulsion has been considered desirable since crystallization of the oxidizer salts is accompanied by desensitization of the explosive. In non-aqueous emulsions, sensitivity loss is usually more significant than in aqueous emulsions. Another reason for stabilization of oil-continuous emulsions is to provide and maintain excellent water resistance, as water is effectively kept away from soluble salts by an oil continuum.

It has not been apparent heretofore that acceptable, indeed excellent, explosive performance is attainable by deliberate destabilization of an emulsion. It has also not been apparent that excellent water resistance is likewise attainable. In fact, anhydrous, oil-continuous emulsion destabilization has not been disclosed, and thus there is no directly pertinent prior art to this invention.

It is the principal objective of this invention to obtain solid microcrystalline compositions employing essentially anhydrous perchlorate based oxidizers and hydrocarbon fuels wherein the intimacy of ingredients in the final product is sufficient to obtain excellent explosive and physical characteristics.

It is another objective to formulate the compositions in a manner which will permit continuous processing, cooling, optional admixing of additives, and loading or packaging before solidification.

Still another objective is to obtain, by extending the range of useable ingredients beyond that which has been applicable to stabilized emulsions or melt-cast explosives, explosive characteristics superior to those which have hitherto been obtained.

A further objective is to achieve water resistance in the explosive compositions.

SUMMARY OF THE INVENTION

This invention describes processes and ingredients by which the above objectives are achieved in perchlorate based explosive compositions, propellants and gas generators. (To avoid redundancy in the discussion which follows, express reference to propellants and gas generators has been limited. However, it is emphasized that the discussion contemplates equally explosives, propellants and gas generators.) This invention effects a new arrangement of matter in which an essentially anhydrous perchlorate based mixture of oxidizer salts, surfactants and organic fuels is mixed while the oxidizer is molten, and a microcrystalline property is created which imparts a hard machinable characteristic to the final product. An explosive embodying this invention is called a microknit composite explosive (MCX).

It has been found that there are at least three distinctly different processes whereby MCX compositions are attainable. The first method involves dissolving surfactants, crystal habit modifiers, thickeners or combinations into the molten oxidizer. Proper selection and concentration of these ingredients permits supercooling with subsequent solidification resulting in a hard, microcrystalline product.

A second method involves the formation of an unstable oil-continuous emulsion as a preliminary step, followed by a controlled disruption of the oil-phase continuum which causes the composition to solidify after supercooling. In this process a mixture of emulsifier and immiscible oil-like fuel is added to the molten oxidizer(s), and an oil-continuous emulsion is formed by mixing. Supercooling is effected by restriction of the size of the oxidizer droplets and their separation from other droplets by the oil-continuous phase. The emulsions, however, are designed to be unstable, i.e., they are deliberately formulated to assure disruption of the oil continuum with subsequent solidification into a hard microcrystalline product.

A third method by which MCX compositions can be made involves salt-continuous emulsions. In these emulsions crystallization normally occurs much more rapidly than in destabilized oil-continuous emulsions. To make the desired MCX compositions by the salt-continuous emulsion route requires that crystal nucleation be retarded by thickeners or crystal habit modifiers or both. By thus retarding crystal nucleation the desired supercooling is achieved with subsequent solidification to a hard product.

Each of these methods permits the manufacturing of numerous perchlorate based MCX formulations from separate nonexplosive ingredients. The manufacturing process minimizes both the quantity of neat explosive and residence time at the manufacturing temperature. Safety is greatly enhanced since only small quantities are in process at a given time, which makes practical the use of ingredients which have been hitherto impractical or unsafe.

DETAILED DESCRIPTION OF PREFERRED EMBODIMENTS

As examples of the first method described in the summary, several formulations were prepared wherein no immiscible fuel was employed and the desired MCX properties were obtained, namely a hard, microcrystalline product. The examples shown in Table I involve a variety of oxidizers, surfactants, crystal habit modifiers and thickeners. In this process the fuels, solid or liquid, were dissolved into the molten oxidizer.

Mix 1 of Table I uses Duomac O as the only fuel. In spite of the high manufacturing temperature, this mix supercooled to ambient temperature before solidification to the desired hard, microcrystalline structure.

In Table I are several additional compositions wherein the constituents were varied and which resulted in significant supercooling, and subsequent microcrystallization to a hard consistency. Each of these examples exhibited good water resistance.

(A key to ingredient abbreviations follows Table I.)

TABLE I

PERCHLORATE BASED MCX COMPOSITIONS MADE BY THE FIRST METHOD

| | Mix No. | | | | | | |
|---|---|---|---|---|---|---|---|
| Formulation (wt %) | 1 | 2 | 3 | 4 | 5 | 6 | 7 |
| $NH_4ClO_4$ | 23.0 | — | — | — | — | — | 23.0 |
| $LiClO_4$ | 56.0 | 50.0 | 57.0 | 60.0 | — | 60.0 | 56.0 |

TABLE I-continued

PERCHLORATE BASED MCX COMPOSITIONS MADE BY THE FIRST METHOD

| | Mix No. | | | | | | |
|---|---|---|---|---|---|---|---|
| Formulation (wt %) | 1 | 2 | 3 | 4 | 5 | 6 | 7 |
| $KClO_4$ | — | — | 10.0 | — | — | — | — |
| $Mg(ClO_4)_2$ | — | — | — | — | 48.3 | — | — |
| $NH_4NO_3$ | — | — | — | 18.0 | — | 20.0 | — |
| $NaClO_3$ | — | — | — | 2.0 | — | — | — |
| $LiNO_3$ | — | — | — | — | 19.7 | — | — |
| K+ Linoleate | — | — | — | — | — | — | 20.0 |
| SDBS | — | — | — | — | 2.0 | 1.0 | — |
| Duomac O | 20.0 | — | — | 10.0 | — | — | — |
| Stearylamine | — | — | 1.0 | — | — | — | — |
| SMO | — | 5.0 | — | — | 2.0 | — | — |
| HAN | — | — | — | 10.0 | — | — | — |
| Starch | — | 5.0 | 15.0 | — | 8.0 | 9.0 | — |
| UREA | — | — | 16.0 | — | — | — | — |
| MEAP | — | 30.0 | — | — | — | — | — |
| RDX | — | — | — | — | 20.0 | — | — |
| Aluminum | — | 10.0 | — | — | — | — | — |
| JMT | — | — | — | — | — | 10.0 | — |
| Microballoons | 1.0 | — | 1.0 | — | — | — | 1.0 |
| Mfr. temp. (°C.) | 185° | 130° | 150° | 160° | 120° | 135° | 185° |
| Results @ 10 5° C. in 3.8 cm dia. | | | | | | | |
| Density (g/cc) | 1.65 | 1.60 | 1.65 | 1.75 | 1.75 | 1.50 | 1.60 |
| #8 Cap | det | det | det | fail | fail | det | det |

INGREDIENT KEY TO TABLES

SDBS = Sodium dodecylbenzene sulfonate
SMO = Sorbitan monooleate
HAN = Hexylamine nitrate
Triton X-45 = an octylphenylethanol, a non-ionic surfactant
Terecol 2900 = Polytetrahydrofuran
HMT = Hexamethylenetetramine
MEAP = Monoethylamine perchlorate
RDX = Cyclotrimethylenetrinitramine
Armac HT = a hydrogenated fatty amine acetate
Duomac O = a fatty duomine acetate
K+ Linoleate = potassium linoleate As discussed in method two the desired MCX properties can be obtained using an oil-continuous emulsion as a preliminary step. Examples of MCX explosives made by this method are presented in Table II. In almost all formulations the preliminary emulsions formed with very little mixing when preheated mixtures of the appropriate surfactants and fuels were added to the molten oxidizer.

In all cases the oil-phase continuity of the original emulsion was destroyed to achieve the desired MCX properties. These emulsions were made to be unstable by the choice of emulsifiers and surfactants, thus assuring the disruption of oil-phase continuity and solidification with the desired properties after cooling.

Anionic, cationic and nonionic emulsifiers and a variety of fuels were used. In mixes 3, 4, and 7 polymeric fuels were employed. When polymers are used an elastomeric property can be imparted.

TABLE II

PERCHLORATE BASED MCX COMPOSITION MADE BY THE SECOND METHOD

| | Mix No. | | | | | | |
|---|---|---|---|---|---|---|---|
| Formulations (wt %) | 1 | 2 | 3 | 4 | 5 | 6 | 7 |
| $NH_4ClO_4$ | 24.0 | — | — | — | 19.1 | — | — |
| $LiClO_4$ | 58.5 | — | 64.0 | 64.0 | 46.4 | 60.0 | 83.0 |
| $Mg(ClO_4)_2$ | — | 60.0 | — | — | — | — | — |
| NH $4NO_3$ | — | — | — | 20.0 | — | — | — |
| $NaClO_3$ | — | — | 20.0 | — | — | — | — |

TABLE II-continued

PERCHLORATE BASED MCX COMPOSITION MADE BY THE SECOND METHOD

| Formulations (wt %) | Mix No. 1 | 2 | 3 | 4 | 5 | 6 | 7 |
|---|---|---|---|---|---|---|---|
| $LiNo_3$ | — | 24.0 | — | — | — | — | — |
| SDBS | — | 6.0 | 2.0 | — | — | — | — |
| Armac HT | 8.5 | — | 5.0 | — | 5.0 | — | — |
| SMO | — | 1.0 | — | 5.0 | — | — | — |
| Duomac O | — | — | — | — | — | 3.0 | 5.0 |
| Mineral oil | — | — | 2.0 | — | — | 7.0 | — |
| Wax | 8.5 | 1.0 | — | — | 4.5 | — | — |
| Polyethylene | — | — | — | — | — | — | 12.0 |
| Coal tar naphtha | — | 7.0 | — | — | — | — | — |
| Terrecol 2900 | — | — | — | 10.0 | — | — | — |
| Polyglycol wax | — | — | 7.0 | — | — | — | — |
| Aluminum | — | — | — | — | 25.0 | — | — |
| MEAP | — | — | — | — | — | 30.0 | — |
| Microballoons | .05 | 1.0 | — | 1.0 | — | — | — |
| Mfr. temp. (°C.) | 190° | 190° | 160° | 170° | 190° | 125° | 250° |
| Results @ 10 5° C. | | | | | | | |
| Density (g/cc) | 1.75 | 1.65 | 1.80 | 1.60 | 2.1 | 1.6 | 1.40 |
| Diameter (cm) | 2.5 | 3.8 | 3.8 | 3.8 | 2.5 | 2.5 | 2.5 |
| Blasting cap (#8) | det | det | det | det | det | det | det |

As discussed in method three, the desired MCX properties can also be obtained using salt-continuous emulsions as a preliminary step. In this type of emulsion the desired supercooling may be achieved if the fuels and surfactants allow very fine ingredient intimacy and if the viscosity of the mixture is sufficiently high to retard molecular movement and thus crystal growth. Crystal habit modifiers are also helpful because of their added influence upon nucleation and crystal growth. These emulsions are made in the same manner as in method two, except that higher shear mixing is usually required. Examples of explosives made by this method are presented in Table III.

Various types of surfactants and thickeners are applicable. Various oxidizer systems and fuels are also useable, with typical MCX physical and explosive properties resulting. Most of these mixes exhibit good to excellent water resistance. In many cases the incursion of water into the surface of the solid product caused an oil-continuous film to develop, blocking further water penetration. Table III also shows that explosives can be formulated by using elastomers as the principal fuels.

TABLE III

PERCHLORATE BASED MCX COMPOSITIONS MADE BY THE THIRD METHOD

| Formulation (wt %) | MIX No. 1 | 2 | 3 | 4 | 5 | 6 |
|---|---|---|---|---|---|---|
| $LiClO_4$ | 60.0 | 57.0 | — | 63.0 | — | — |
| $Mg(ClO_4)$ | — | — | 60.3 | — | 60.3 | — |
| $NH_4NO_3$ | — | 19.0 | — | 21.0 | — | — |
| $LiNO_3$ | — | — | 24.7 | — | 24.7 | 13.0 |
| $KClO_4$ | — | — | — | — | — | 10.0 |
| SDBS | — | — | 2.0 | 2.0 | 3.0 | — |
| Duomac O | 4.0 | — | — | — | — | — |
| SMO | — | — | 2.0 | — | 3.0 | — |
| HAN | — | 1.0 | — | 2.0 | — | — |
| Triton X-45 | 2.0 | 2.0 | 1.0 | — | 3.0 | 2.0 |
| Starch | — | 10.0 | — | — | — | 20.0 |
| UREA | — | 10.0 | — | — | — | — |
| HMT | — | — | — | 10.0 | — | — |
| Mineral oil | 2.0 | — | — | 2.0 | 3.0 | — |
| Coal tar naphtha | 2.0 | — | 1.0 | — | 3.0 | 4.0 |
| Dicylopentadiene | — | — | 3.0 | — | — | — |
| Styrene resin | — | — | 5.0 | — | — | — |
| MEAP | 30.0 | — | — | — | — | — |
| Microballoons | — | 1.0 | 1.0 | — | — | 1.0 |
| Mfr. temp. (°C.) | 130° | 165° | 120° | 135° | 120° | 125° |
| Results @ 10 5°C. | | | | | | |

TABLE III-continued

PERCHLORATE BASED MCX COMPOSITIONS MADE BY THE THIRD METHOD

| Formulation (wt %) | MIX No. 1 | 2 | 3 | 4 | 5 | 6 |
|---|---|---|---|---|---|---|
| Density (g/cc) | 1.55 | 1.70 | 1.60 | 1.50 | 1.80 | 1.50 |
| Diameter (cm) | 2.5 | 2.5 | 2.5 | 3.8 | 3.8 | 2.5 |
| #8 cap | det | fail | fail | det | fail | det |

It has been shown that the desired physical and explosive properties are attainable by different methods, and that one of the desired properties is supercooling before solidification. A broad range of ingredients has been shown to be applicable in contrast to the narrower ranges applicable to stabilized oil-continuous emulsions and melt-cast explosives.

Increasing the number of applicable ingredients has many important ramifications. The surface chemistry requirements are much less stringent if an emulsion does not have to be stabilized. Ingredients or manufacturing conditions which interfere with stabilized emulsions can often be used to advantage in MCX formulations. This applies to ingredients in either phase of the original emulsion or to ingredients added after the emulsion is formed.

MCX formulations may involve molten oxidizers having melting temperatures considerably in excess of those considered practical for oil-continuous stabilized emulsions. In general, the higher the melting point of the oxidizer, the more difficult it is to stabilize an emulsion. It has been found practical to make MCX products involving oxidizers having melt temperatures as high as 250° C. Nevertheless, supercooling characteristics have been achieved which allow cooling to ambient or near ambient temperatures before solidification. The use of more powerful perchlorate oxidizers having higher melting points than the oxidizers suitable for use in the prior art of stable oil-continuous emulsions or melt-cast explosives permits the achievement of superior explosive properties in MCX compositions. Mix 5 in Table II demonstrated cap sensitivity at a density of 2.1 g/cc in a 2.5 cm diameter charge. This was achieved with no self-explosive ingredients or density control agents in the composition.

MCX formulations also lend themselves to the use of an extended range of fuels including thermoplastic polymers, crosslinkable polymers, and polymerizable fuels. Refinement of the emulsion is critical to stabilize an emulsion, but it is less critical if a stable emulsion is not the aim. Thus higher viscosity fuels are easier to employ in MCX compositions. Further, the use of higher temperatures generally reduces viscosity. For polymerizable or crosslinkable fuels, the chemistry of polymerization or crosslinking has fewer restrictions if emulsion stabilization is not a major concern. A much wider variety of polymeric fuels thus becomes useable. MCX formulations which make use of polymeric fuels are especially applicable to rocket propellants and gas generators wherein resiliency is required. Polyethylene, polystyrene esters, and crosslinkable polyols are examples of polymeric materials which have been employed successfully in perchlorate based MCX formulations.

The range of fuels is extended in other ways. Immiscible fuels having relatively low boiling points (high vapor pressures) are applicable to MCX products but not to oil-continuous emulsions. Fuel vapor pressure is one cause of emulsion breakdown, particularly at high temperatures. In MCX formulations a wider variety of aromatic or aliphatic oils is therefore applicable. A broader spectrum of higher energy fuels and potential sensitizers thus becomes useable. Fuels having high vapor pressures have been employed as emulsion destabilizers in MCX formulations. However, if such fuels are used, it has been found that crystal habit modifiers and rapid cooling are useful to avoid excessive ingredient separation and desensitization. Rapid product cooling favors small crystals with concomitant large solid surface area upon which the fuels may be adsorbed, thus reducing the opportunity for ingredient separation.

The range of polar fuels, those soluble in molten salt, is also extended because such fuels may affect the surface chemistry in a manner disruptive of emulsion stability.

Thus, by each of the three methods described, it is possible to produce MCX compositions in which an extremely broad range of ingredients is applicable. Therefore, a correspondingly broad range of claims relating to ingredients is a necessary consequence.

We claim:

1. An arrangement of matter which is a solid, perchlorate based, microcrystalline explosive, propellant or gas generator, comprising in combination as essentially anhydrous mixture of surfactant(s), hydrocarbon fuel(s) and inorganic oxidizer salt(s), involving the mixing or dissolving of ingredients while they are in the molten state, the intimately mixed fluid having the property of permitting the molten salt(s) to be supercooled before the occurance of crystal nucleation and reversion from the fluid state and wherein moisture which may be present is water of hydration or because of the hygroscopic nature of said oxidizer salts and is limited to 3% maximum by weight of the composition.

2. An explosive of claim 1 wherein the oxygen balance is between +5% and −30%.

3. An explosive of claim 1 wherein the composition employs metallic fuels, in which case the oxygen balance is between +5% and −50%.

4. An explosive of claim 1 wherein the surfactant concentration is from 0.05% to 25% of the composition by weight; and the fuel portion may be constituted entirely of one or more surfactants.

5. An explosive of claim 1 wherein $LiClO_4$ is the principal salt.

6. An explosive of claim 1 wherein additives selected from the group consisting of ammonium, sodium, potassium, magnesium, calcium, strontium, barium, copper, zinc, manganese and lead perchlorates, nitrates, chlorates and nitrites may be added; and where the concentration of any single such additive is limited to 45% by weight of the total composition.

7. An explosive of claim 6 wherein any soluble and compatible potassium salt is added to phase stabilize $NH_4NO_3$ if present.

8. A specific explosive of claim 1 wherein $NH_4ClO_4$ is an additive.

9. An explosive of claim 1 wherein the fuel is polymerizable or crosslinkable and where polymerization or crosslinking or both may be accomplished in situ.

10. An explosive of claim 1 wherein the fuel is a thermoplastic polymer.

11. An explosive of claim 9 wherein the polymerizable fuels are selected from the group consisting of polyesters, polyethers, polydienes, polysulfides, polyperflourocarbons, polyolefins, polyamines, polyalkanes, polyphenols and polyacetylenes.

12. An explosive of claim 1 wherein the hydrocarbon fuel is nonpolymerizable.

13. An explosive of claim 1 wherein the surfactants are emulsifiers selected from the group having R-groups greater than 12 carbon atoms in length ordinarily used to form oil-continuous emulsions.

14. An extension of claim 1 wherein the surfactants are selected from the group having a carbon chain length of from 6 to 12 carbon atoms ordinarily used for water-continuous emulsions.

15. An extension of claim 1 wherein the surfactants are crystal habit modifiers selected from the dialkylnaphthalenesulfonates.

16. An extension of claim 1 wherein additives selected from the aromatic or alkylaryl surfactants may be employed.

17. An extension of claim 1 wherein soluble fuels or soluble compound explosives may be employed in the oxidizer portion of the originally fluid mixture.

18. An extension of claim 1 wherein the originally fluid mixture may be employed as a matrix into which insoluble solids may be added.

19. An extension of claim 18 wherein the added solid is a compound explosive.

20. An extension of claim 18 wherein the added solid is a metallic fuel.

21. An extension of claim 17 wherein the soluble compound explosive is the nitrate or perchlorate adduct of an alkylamine or alkanolamine.

22. An extension of claim 17 wherein the soluble compound explosive is an oxidizer.

23. An explosive of claim 1 wherein molten compound explosives which are insoluble may be dispersed in the originally fluid mixture.

24. An explosive of claim 17 wherein the compound explosive is selected from the group consisting of hexamethylenetetraminenitrates or hexamethylenetetramineperchlorates made in situ.

25. An explosive of claim 1 wherein a compound explosive is selected from the group consisting of metal ammonia coordination compounds.

26. An explosive of claim 17 wherein the compound explosive is a nitroazole salt.

27. An explosive of claim 1 wherein density control or sensitization is achieved by the use of additives selected from microballoons, perlite, fumed silica, entrained gas or gas generated in situ.

28. An explosive of claim 1 wherein no sensitization is effected by either density control or the addition of compound explosives.

* * * * *